US005140293A

United States Patent [19]

Fournier et al.

[11] Patent Number: 5,140,293

[45] Date of Patent: Aug. 18, 1992

[54] MANUAL CONTROL DEVICE FOR THERMAL RELAYS

[75] Inventors: Bernard Fournier, Le Plessis Bouchard; Philippe Rix, Paris, both of France

[73] Assignee: Telemecanique, France

[21] Appl. No.: 686,821

[22] Filed: Apr. 18, 1991

[30] Foreign Application Priority Data

Apr. 20, 1990 [FR] France ..... 90 05494

[51] Int. Cl.[5] ..... H01H 71/16; H01H 3/48

[52] U.S. Cl. ..... 337/37; 200/342; 337/91

[58] Field of Search ..... 337/1, 2, 3, 5, 6, 12, 337/13, 37, 91, 298; 335/6, 23, 35; 200/342, 341, 329, 330, 331

[56] References Cited

U.S. PATENT DOCUMENTS 3,750,076 7/1973 Hines ..... 337/91

4,965,420 10/1990 Phillips et al. ..... 200/342

*Primary Examiner*—Harold Broome

*Attorney, Agent, or Firm*—William A. Drucker

[57] ABSTRACT

A device is disclosed for the manual control of thermal relays, comprising a case with a push-button on a front wall and having a transmission member; the latter comprises a rigid support and a resilient lever applicable on the stop and re-set pushers of a thermal relay. A drive element proper to the push-button is applicable on an intermediate zone of the resilient lever.

8 Claims, 2 Drawing Sheets

MANUAL CONTROL DEVICE FOR THERMAL RELAYS

BACKGROUND OF THE INVENTION

The present invention relates to a device for housing and manually controlling an electric relay for protection against overloads, of the thermal relay kind associated with a contactor.

It is usual to house electric switching apparatus protected against overloads and formed by the association of a contactor and a thermal relay in receptacles such as cases.

It is useful to recall that the contactor comprises a control electromagnet and determines the starting and stopping of a power load, for example a motor, as a function of the current which flows through the coil of the electromagnet. The thermal relay determines stopping of the motor, particularly in the case of an overload in at least one phase conductor of the motor : for this, the thermal relay comprises a switch which is controlled by an opening mechanism responsive to the deflection of bimetallic strips in the case of overloads and which is disposed electrically in series with the coil of the electromagnet of the contactor.

The opening mechanism must be re-set after each tripping procedure. Depending on the type of thermal relay considered, re-setting is either manual or automatic, or manual and automatic, including in this latter case a manual-automatic selection means. Manual re-setting takes place by means of a pusher disposed on the front face of the thermal relay.

In addition, it is often required in a thermal relay to be able to manually control stopping of the contactorthermal relay assembly by means of another pusher, also disposed on the front face of the thermal relay and acting on the opening mechanism for opening the switch.

When the contactor-thermal relay assembly is mounted in a case, a control push-button is provided on a front wall thereof. By pressing this button, an operator acts on the pushers for stopping and re-setting the thermal relay. This stopping and re-setting action is transmitted to the pushers of the thermal relay by transmission means whose role is to transform the movement of the control push-button into movement of the controlled pushers, while taking into account lost motion for application on the pushers and, on the other hand, staggering between the push-button and the pushers of the thermal relay.

SUMMARY OF THE INVENTION

An object of the invention is in particular to provide in a very simple way the mechanical transmission between the control push-button accessible from outside the case and the pushers of the thermal relay situated inside the case, while providing as desired an actuating priority and/or permitting a shift of the position of the two pushers.

According to the invention, in a device of the type described in the introduction, the transmission means comprise : a rigid support fixed to a wall of the case, a resilient lever embedded at one end in the support and applicable close to its other end—which is free—on one at least of the pushers of the thermal relay, a drive element carried by a movable element of the push-button and applicable on an intermediate zone of the resilient lever.

The desired transmission of movement takes place then very simply, inexpensively and with reduced dimensions, particularly when the resilient lever is molded in a single piece with the rigid support.

The free end of the resilient lever advantageously comprises two bearing zones applicable respectively on the stop pusher and on the re-set pusher, so as to provide priority driving in of the re-set pusher and permitting positioning latitude of the pushers. The bearing zones are preferably situated at the free ends of two separate legs of the resilient lever.

BRIEF DESCRIPTION OF THE DRAWINGS

The characteristics of the invention will be explained by the description of a non limitative embodiment, with reference to the accompanying drawings.

DESCRIPTION OF THE PREFERRED EMBODIMENT

Figure 1:
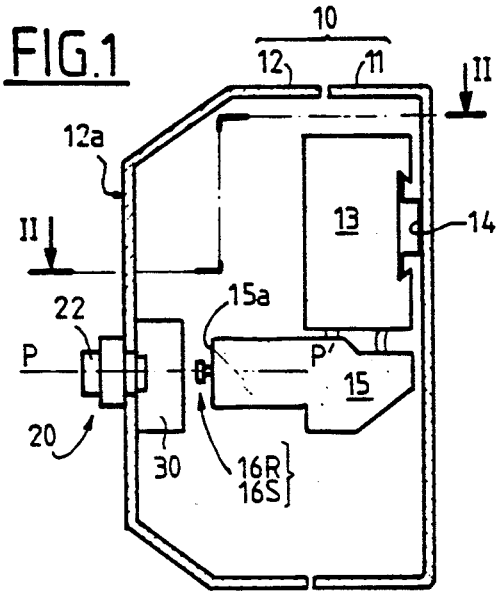
FIG. 1 shows in schematic section a side view of a case in accordance with the invention.
Figure 4:
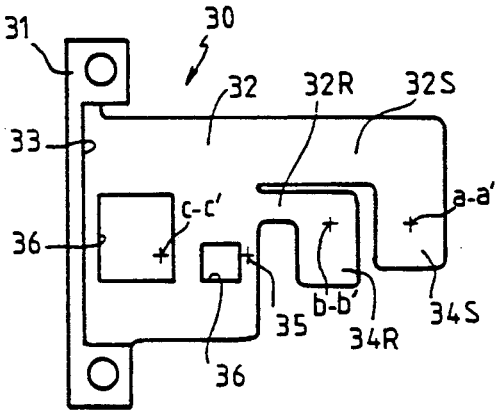
FIG. 4 is a view in the direction of arrow B of the transmission member.
Figure 2:
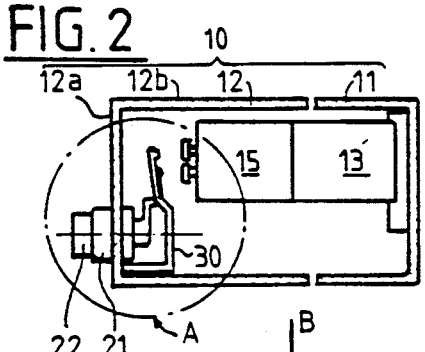
FIG. 2 is a section through II—II of the case of FIG. 1.

Case 10 illustrated in FIG. 1 comprises a bottom 11 and a lid 12, the latter having a front wall **12*a* and side walls 12*b*. The bottom and the lid are assembled together by means not shown. The case houses a contactor 13 clipped on to a shaped bar 14 and a thermal relay 15 fixed under the contactor and whose can has on its front face 15*a* a stop pusher 16S with axis a—a′ and a re-set pusher 16R** with axis b—b′.

On the front face **12*a* of the case is fixed a push-button 20** with axis c—c′. The axes a—a′, b—b′, c—c′ are situated in the same horizontal plane P—P′, but may of course be located in separate planes.

The push-button 20, of a maintained contact type in this example, comprises a body 21 fixed to the front wall **12*a* of the case, a pusher properly speaking 22 movable in direction c—c′, a clamping ring 23 cooperating with a threaded portion of the body for fixing it to wall 12*a*, a return spring 24 and a drive element 25. Element 25 is driven by pusher 22 which cooperates with a transmission member 30**.

The movement and force transmission member 30 comprises a rigid support 31 and a resilient lever 32. Support 31 is fixed by screws or similar means to the front wall **12*a* of the case. The rigid support may also be fixed to the body of the push-button or be integral therewith, or be fixed to a side wall 12*b*** of the case.

The resilient lever 32 comprises two legs 32R, 32S, associated respectively with the re-set button 16R with axis b—b′ and with the stop button 16S having axis a—a′. These legs are embedded at one end 33 in the rigid support 31 and are applicable by bearing zones 34R, 34S situated at their free ends, on the respective buttons 16R, 16S. The bearing zones are sufficiently wide to allow a given push-button with axis c—c′ to actuate thermal relays whose pushers will not always be positioned in the same place.

The resilient lever 32 is preferably molded in a single piece with the rigid support 31; of course, without departing from the spirit of the invention, it may also be formed by cutting out and bending a metal sheet which is fixed to the rigid support 32 by appropriate fixing means.

The two legs 32R, 32S of lever 32 are designed to begin to bend simultaneously under the effect of the actuation of push-button 20, then to finish their travel independently of each other. The geometry and stiffness of the legs are moreover determined so that the re-set button 16R is actuated before the stop-button 16S for reasons which relate to the arrangement and functionalities of the thermal relay 15.

The movable element 25 of push-button 20 is housed in pusher 22 so as to move integrally therewith and comprises, on the one hand, a projecting element 25*a* such as a shoulder or a drive finger applicable on an intermediate zone 35 of the resilient lever 32 and, on the other hand, lugs 25*b* passing through passages 36 in the lever for being applied thereunder and returning it to the rest position (FIG. 3) under the effect of spring 24. The position of zone 35 is provided so that the translational movement of pusher 22 causes an amplified movement of bearing zones 34R, 34S.

The operation of the device described is the following. To manually trip the thermal relay 15, the operator presses pusher 22. Finger 25*a* moves down (FIG. 3), and is applied on the intermediate projecting zone 35 of the resilient lever 32. The latter bends in a direction substantially parallel to the translational axis of pusher 22 and legs 32R, 32S move down and are applied on the respective buttons 16R, 16S. Thus, pusher 16R sets the re-set portion of the opening mechanism M of the thermal relay and pusher 16S causes opening of switch I via the tripping portion of the same mechanism. The initial and final positions of pushers 16R, 16S are respectively shown at 1 and 2 in FIG. 3.

Figure 3:
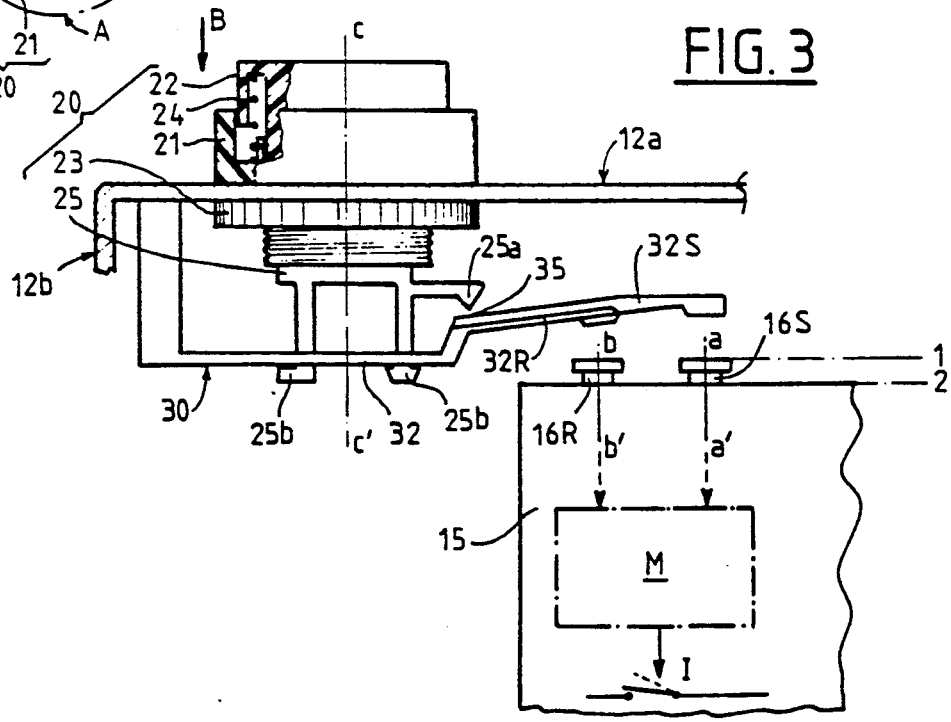
FIG. 3 shows on a larger scale the detail A of FIG. 2.
Figure 5:
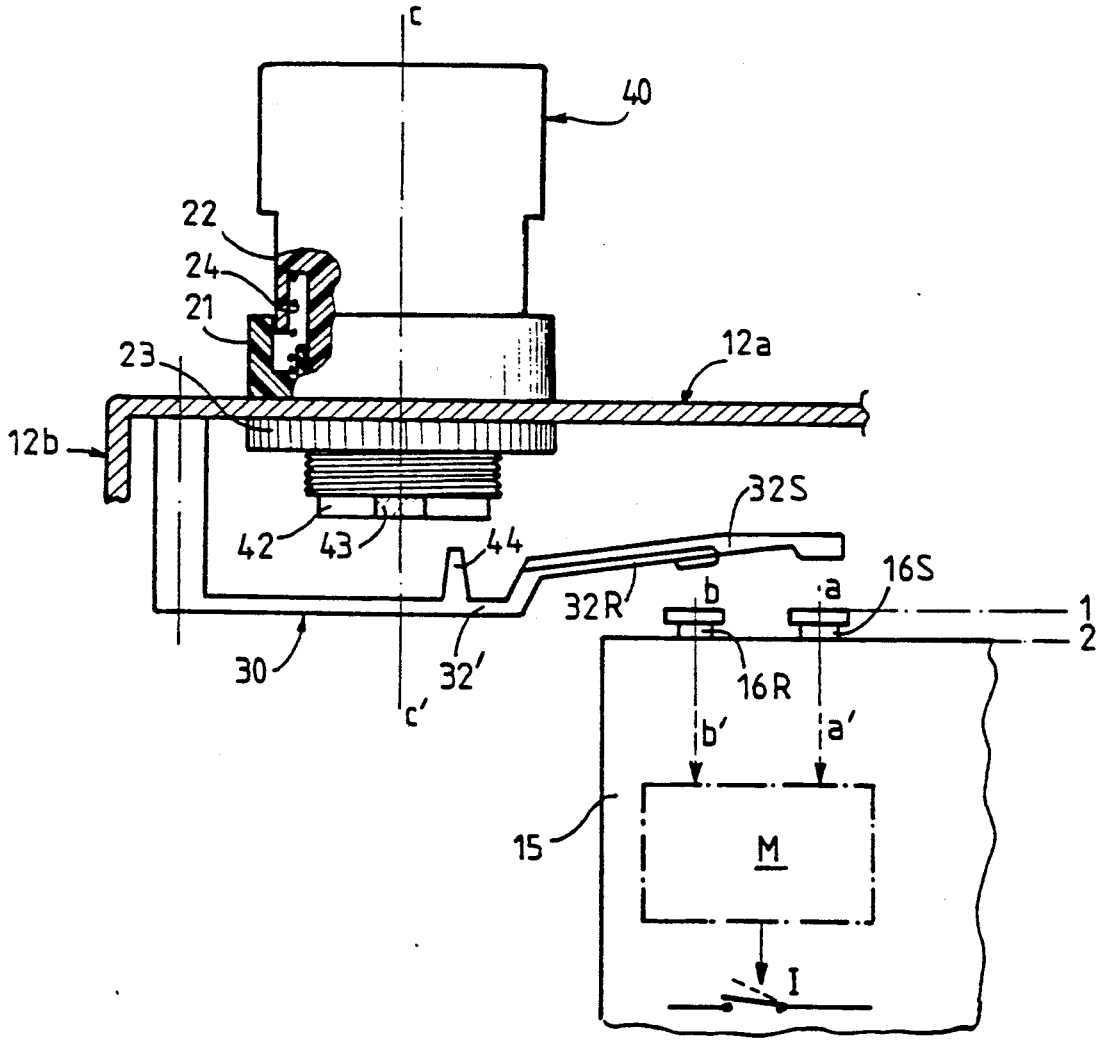
FIG. 5 is a view identical to FIG. 3 showing a variant of the drive element.

According to a variant illustrated in FIG. 5, in which the elements identical to those of FIG. 3 bear the same references, the push-button 40, here of locked type, namely having a position maintained by pressing the pusher 22 and a position unlocked by turning said pusher, comprises a drive washer 42 mounted coaxially about a screw head 43 with axis c—c', which screw is engaged in a threaded portion of pusher 22 so as to move integrally therewith. Washer 42 is applied, following a pressure exerted on pusher 22, on a boss 44 formed on the resilient lever 32'.

Manual tripping of the thermal relay 15 by means of the device according to this modification takes place in a way similar to that described with reference to FIG. 3. When the operator pushes the pusher 22, washer 42 moves down and is applied on the boss 44 of the resilient lever 32'. By bending, the latter applies legs 32R, 32S on the respective buttons 16R, 16S, such application being maintained because the push-button 40 is held in position at the end of the manual pressure.

The transmission member 30 then comes back to its initial position (FIG. 5) when the operator turns the pusher 22, thus unlocking the push-button 40.

What is claimed is:

1. A device for housing and manually controlling a thermal relay associated with a contactor, the thermal relay comprising a can having a front face and a stop pusher and a re-set pusher located on said front face, the device comprising a case having a front wall and a push-button located on said front wall and further comprising transmission means for allowing the push-button to actuate the said stop pusher and the said re-set pusher, wherein said transmission means comprise:

i) a rigid support fixed to a wall and of the case, ii) a resilient lever having a first end embedded in the rigid support and a second free and which cooperates with at least one of the said stop pusher and said re-set pusher, iii) the push-button having a movable part and a drive element carried by said movable part cooperating with a surface portion of the resilient lever intermediate between said first and second ends.

2. The device as claimed in claim 1, wherein the second end of said resilient lever comprises two bearing zones which respectively cooperate with the stop pusher and the re-set pusher.

3. The device as claim in claim 2, wherein said second end forms two resilient legs separated from each other on which said bearing zones are respectively located.

4. The device as claimed in claim 1, wherein the push-button has a return spring and the movable part of the push-button comprises at least one lug which engages the resilient lever for resetting the latter under the effect of said return spring.

5. The device as claimed in claim 1, wherein a boss is formed on the resilient lever and the drive element carried by said movable part is a washer cooperating with said boss.

6. The device as claimed in claim 4, wherein the drive element carried by the movable element part is shaped as a projecting finger.

7. The device as claimed in claim 1, wherein said resilient lever is molded in a single piece with the rigid support.

8. The device as claimed in claim 1, wherein said resilient lever and said rigid support form two separate pieces fixed together and the resilient lever is formed by cutting out and bending a metal sheet.

* * * * *